United States Patent [19]

Mayer et al.

[11] Patent Number: 4,523,508

[45] Date of Patent: Jun. 18, 1985

[54] IN-LINE ANNULAR PISTON FIXED BOLT REGENERATIVE LIQUID PROPELLANT GUN

[75] Inventors: Robert E. Mayer, Williamstown; Inder K. Magoon; Herbert J. West, both of Pittsfield, all of Mass.

[73] Assignee: General Electric Company, Fairfield, Conn.

[21] Appl. No.: 547,959

[22] Filed: Nov. 2, 1983

[51] Int. Cl.[3] ..... F41F 1/04

[52] U.S. Cl. ..... 89/7; 89/8

[58] Field of Search ..... 89/7, 8, 11, 1 R

[56] References Cited

U.S. PATENT DOCUMENTS

| | | | |
|---|---|---|---|
| 3,138,990 | 6/1964 | Jukes et al. | 89/7 |
| 4,023,463 | 5/1977 | Tassie | 89/7 |
| 4,050,349 | 9/1977 | Graham | 89/7 |
| 4,099,445 | 7/1978 | Singelmann et al. | 89/7 |
| 4,100,836 | 7/1978 | Hofmann | 89/7 |
| 4,269,107 | 5/1981 | Campbell | 89/7 |
| 4,281,582 | 8/1981 | Jagua | 89/7 |
| 4,341,147 | 7/1982 | Mayer | 89/7 |

*Primary Examiner*—David H. Brown

*Attorney, Agent, or Firm*—Francis K. Richwine; Bailin L. Kuch

[57] ABSTRACT

A regenerative liquid propellant gun structure in which the differential area piston is annular, having a peripheral cylindrical skirt extending away from the combustion chamber to define a propellant reservoir, and has an aperture permitting overrunning of a fixed bolt. The fixed bolt is shaped to define with the edge of the aperture a variable annual orifice for propellant injection as the piston moves. There is a second free piston overrunning the bolt and mating with the inside of the differential area piston to complete and provide for emptying of the reservoir. The structure also contains a spring to allow components to move responsive to increased combustion chamber pressure to provide for an initial movement of differential area piston relative to the bolt to start propellant injection and a fluid pressure means for movement of pistons after firings to facilitate reloading.

35 Claims, 5 Drawing Figures

IN-LINE ANNULAR PISTON FIXED BOLT REGENERATIVE LIQUID PROPELLANT GUN

RELATED APPLICATIONS

This Application is related to co-pending U.S. Patent Applications Ser. Nos. 840,074; 840,075; and 840,104; filed Oct. 6, 1977 and is a companion to Application Ser. No. 06/547,958.
(Assignee's docket number 35-OR-860-1) filed concurrently.

BACKGROUND OF THE INVENTION

1. Field of the Invention

This invention relates to liquid propellant guns utilizing differential area pistons to provide continued or regenerative injection of a liquid propellant into the combustion chamber and, particularly, to such guns in which there are a plurality of coaxial elements, including at least one differential area piston, arranged so as to provide for relative action between elements as a means for controlling regenerative propellant injection.

2. Description of the Prior Art

An extensive summary of the prior art appears in the "Description of the Prior Art" of U.S. Pat. Nos. 4,341,147 to R. E. Mayer. The patents to R. A. Jukes et al., U.S. Pat. Nos. 3,138,990, June 30, 1964; D. P. Tassie, 4,023,463, May 17, 1977; and A. R. Graham, 4,050,349, Sept. 27, 1977; cited in that document and Mayers U.S. Pat. No. 4,341,147 itself are exemplary of that prior art. In general, the references cited show differential pressure pistons for forcing liquid propellant from a reservoir chamber into a combustion chamber responsive to combustion pressures. The most pertinent of the prior art cited to this disclosure are those in which a moving differential area piston cooperates with another member, e.g. the fixed bolt 45 in FIG. 4 of Mayer's U.S. Pat. No. 4,341,147, to control the flow rate or dispersion pattern or both of the propellant as it is pumped to the combustion chamber. The co-pending Applications cited are also pertinent because they disclose a reverse hollow piston arrangement also using a fill piston.

SUMMARY OF THE INVENTION

This invention pertains to a novel breech, receiver and combustion chamber structure for a liquid propellant gun of the regenerative injection monopropellant type and pertains to structures in which a moveable differential area piston cooperates with another structural element to control propellant flow rate or dispersion pattern or both as the propellant is pumped from a reservoir chamber to a combustion chamber by a piston responsive to combustion pressures. Most specifically, the invention contemplates an in-line annular piston (i.e. axially aligned with the gun bore and moving in direct reaction to the projectile) supported within the breech mechanism section for reciprocal overrunning motion axially of a fixed central bolt member wherein the cylindro-annular space between the cylindrical piston wall and the bolt constitutes the reservoir chamber and a variable annular opening between the bolt and the annular disk-like piston head as the piston is displaced is controlled to throttle the flow of propellant. The invention disclosure also contains structural refinements facilitating loading, sealing, ignition and survival including a second piston used in the charging process. The principal configuration has been successfully tested by repetitive firings to demonstrate the efficacy of the structure for obtaining desired ballistic results from predetermined breech pressure and time relationships as a result of controlled injection and burn rates.

DESCRIPTION OF THE INVENTION

General

Figure 1:
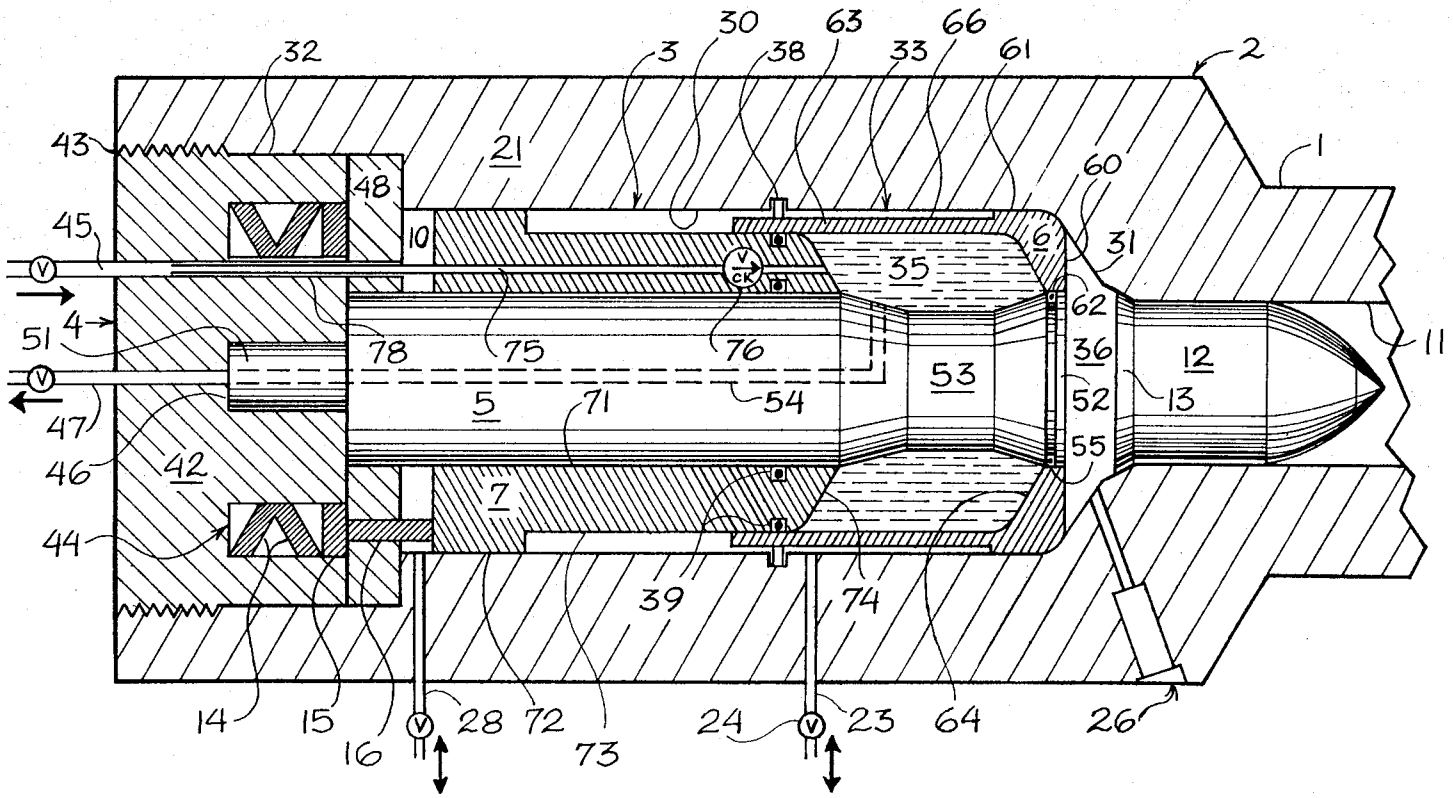
FIG. 1 is a longitudinal sectional view of one implementation of a full charged breech section of a regenerative liquid propellant gun in accordance with this invention.
Figure 2:
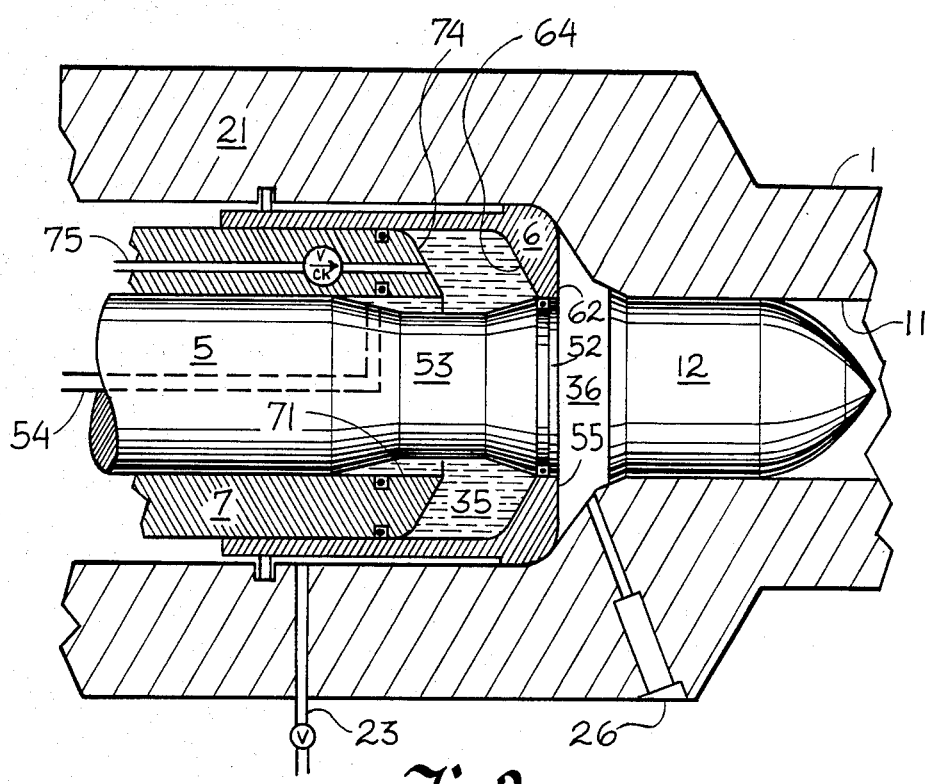
FIG. 2 is a partial longitudinal section view of the gun structure of FIG. 1 showing the position of elements during charging.
Figure 3:
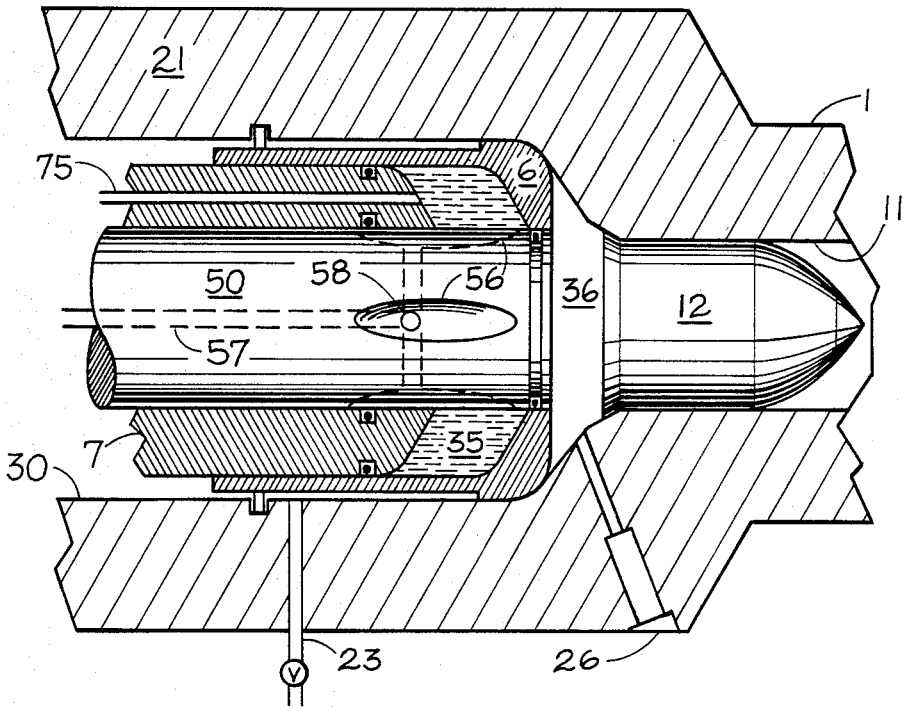
FIG. 3 is a partial longitudinal section view of a gun structure having a modified bolt structure with elements positioned as in FIG. 2.

The implementation of the breech or chamber section of a liquid propellant gun according to the invention and as illustrated in FIGS. 1, 2 and 3 of the drawings includes, as common to most fire arms and cannon, a gun barrel 1 attached to an enlarged breech mechanism section 2 which includes provisions for the introduction, ignition and burning of a propellant material to create a gas to drive a projectile through the barrel. The breech section 2 of this gun includes a casing 21 surrounding and defining a chamber 3, a breech plug or obturator structure 4 supporting a fixed bolt 5 and two moveable pistons 6 and 7. The moveable pistons cooperate with the bolt to accept, retain and dispense liquid propellant in a metered fashion in response to pressure created by combustion acting on differential area pressure piston 6.

Chamber 3 as defined by the interior wall 30 of the casing is generally cylindrical but is illustrated as having a conical end wall portion 31 to provide an interconnection with the bore 11 of barrel 1 without impeding gas flow and an enlarged portion 32 representing a facility for positioning and securing a breech closure mechanism, as for example, the breech plug structure 4, to provide reaction to propulsion pressures. Breech plug structure 4 is representative of a wide range of possible designs and is illustrated as having plug portion 42, interconnection means 43 which might be, for example, an interrupted screw connection for securing the plug to the breech casing 21, conduits 45 and 47, spring assembly 44 and bolt receptacle 46 supporting the fixed cylindrical bolt 5 by means of bolt projection 51. Breech plug 4 may be made with one or more separate portions e.g. 48 to facilitate assembly.

Principle Components

The differential area annular piston 6 has a cylindrical skirt portion 63 which serves as a piston rod and primarily defines cylindro-annular reservoir 35 about the bolt 5 which varies in capacity as the piston moves within the operating cylinder portion of chamber 3. Piston head 60 separating reservoir 35 from combustion chamber 36 is itself disk-like and annular as it has a central hole defined by the cylindrical surface 62 dimensioned to the principal diameter of bolt 5 to permit overrunning the bolt. The interior surface 64 of cylinder head 60 which may be shaped as illustrated to facilitate propellant flow and to provide appropriate strength has, because of the thickness of skirt wall 63, a lesser area than the exterior head surface and causes piston 6 to be a differential area piston acting between the combustion chamber 36 and reservoir 35. The head 60 of the annular piston 6 also has a portion 61 journaled to the interior surface 30 of chamber 3 which could be fitted with a piston ring and a reduced portion 66 which creates an annular space 33 between the piston skirt and the interior surface 30 of the breech casing. Annular space 33 is also sealed off by ring barrier 38 (which may bear a seal) mounted in the wall of casing 21. One or more fluid conduits 23 controlled by valve 24 passes through the casing to provide fluid communication between space 33 and the exterior so that space 33 can be prefilled with a liquid which affords hydraulic support to piston wall 66 during firing. Space 33, depending on materials selected, may also be used to supply a lubricating material, as a reservoir of material to create a hydrodynamic bearing at 61 or as a dispenser of material such as a barrel treatment substance for dispersion during firing.

The remaining principal component of the breech structure illustrated in FIG. 1 is the block or fill piston 7 which is a cylindrical structure having an interior axial bore 71 journaled on the principal cylindrical section of bolt 5, a first exterior cylindrical surface 72 at the rear extremity of the piston journaled to the chamber wall 30 and a reduced cylindrical surface 73 journaled into the interior surface of skirt 63 of the annular piston 6. The axial length of the skirt 63 of the annular piston is less than the length of the reduced diameter cylindrical portion 73 of the fill piston, and the nose portion 74 of the fill piston is shaped to fit the interior surface 64 of piston head 60. The overall length of fill piston 7 and the chamber are such that a space 10 is provided between the rear of the piston and the proximate surface of breech plug 4. The nose portion 74 of the fill piston constitutes the final surface of propellant reservoir 35. Fill piston 7 is also provided with a conduit 75 (containing a check valve 76) running entirely through the piston as a means for inserting propellant into the reservoir, and a connecting tube 78 for continued communication with conduit 45 in the breech plug 4 during reciprocal axial movement of the piston 7 during charging. Seals 39, which are generally aligned and aligned with ring barrier 38 so as to balance forces, are provided to preclude leakages.

Bolt 5 is fixed in place in the breech structure axially of the gun by breech plug structure, is generally cylindrical and provides support for the moveable pistons 6 and 7 through the portion of piston 7 which is journaled on the principal uniform surface of the bolt. An essential aspect of this invention is embodied in the shaped or contoured portion of the bolt which in the FIG. 1 version has a reduced radii surface in the area designated by 53 which is within the propellant reservoir. This reduced radii surface produces an annular gap between bolt 5 and piston head 60 as the piston 6 is moved which is varied as a means for controlling the propellant flow rate. The variable annular gap produces an annular sheet pattern of variable thickness of propellant injection into the combustion chamber. Although the shaped area 53 of the bolt in FIG. 1 is one that would produce a simple rise and fall of propellant rate of flow, it is only representative. More complex contoured or undulating surfaces may be required for some internal ballistic combinations. Bolt 5, at the combustion chamber end terminates with a noselike portion having a cylindrical surface 52 generally of the principal diameter of the bolt to which surface 62 of piston 6 is mated and carries a seal 55. The surfaces 52 and 62 could be made slightly conical to enhance seating and sealing during charging and may be provided with seals. Bolt 5, as illustrated, is also provided with a conduit 54 communicating between conduit 47 in the breach plug and reservoir 35 toward the rear portion of the reduced radii portion 53 of the bolt surface.

Buffer and Battery Drive Structure

Spring assembly 44 as illustrated is made up of a plurality of belleville disk washers 14 and a compression ring 15 in an annular channel in the breech plug and a plurality of pressure pins or studs 16 spaced around the face of ring 15 for the transfer of forces from the fill piston 7 as it is subjected to additional forces, as for example as explained later, with respect to the unseating of differential area piston 6 on ignition. Other structure, for example, a liquid spring, liquid damper, coil springs, etc., could be substituted.

The structure also includes an igniter means 26, a valved conduit 28 for the introduction of fluid pressure into space 10 to permit use of space 10 as a drive cylinder to move fill piston 7 toward the barrel as a means for seating piston 6 and for emptying reservoir 35 to prepare it for filling. Provision for injection of a measured amount of propellant could be included with the ignitor means.

The FIGURES also show a projectile 12 having an obturation band portion 13 in the "loaded" position. The illustrations do not show a specific mechanism for insertion of projectiles as the invention can be used in combination with any appropriate operating mechanism e.g. sliding breech block, pivoted breech or removable chamber components.

The invention is illustrated and described as having a single bolt or shaped member cooperating with a single hole or cutout portion in the head of the differential area piston for feeding liquid propellant from the reservoir to the combustion chamber. The use of multiple bolts and cut away portions to increase flow rate or to enhance dispersion, particularly in the form of annular thin sheets, would be within the scope of this invention.

Modification of FIG. 3

Figure 5:
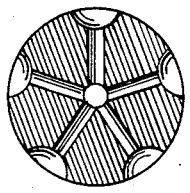
FIG. 5 is a cross section of a further modification of the bolt structure shown in FIG. 3 in which there are five cut outs.
Figure 4:
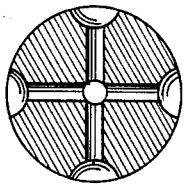
FIG. 4 is a cross section of the bolt structure of FIG. 3.

The gun mechanism of FIG. 3 differs from the implementation illustrated in FIGS. 1 and 2 by the use of a modified bolt 50 which is mounted in the structure in the same way as bolt 5, but is different from bolt 5 in that bolt 50 is fluted or scalloped or has a plurality of cut away portions or depressions 56 in the surface of the bolt proximate its forward end rather than a general reduced portion 53 and has a conduit 57 which has multiple openings 58, one in each depression 56. The additional openings 58 are needed so as to remove through conduit 57 any ullage which may be entrapped in the cut away portions. FIGURES 3 and 4 show four cuts 56 evenly spaced about the circumference of the cylindrical bolt and having dished bottoms of generally the same bottom configuration as the reduced portion 53 of bolt 5, but deeper. The bolt concept illustrated in FIGURES 3 and 4 anticipates that the actual number and configuration of cut away portions 56 are design variants which must be selected by design parameters or empirically so as to obtain the proper flow rate and dispersal pattern in view of the specific propellant, caliber, piston and bolt sizes, and chamber pressure and time relationships required. FIG. 5 shows a cross section of another pattern of bolt cut outs having an odd rather than even number of cuts which could be cut by use of a milling cutter or grinding wheel. Interior resonances can be modified or varied by the number, spacing, size and shape of the cuts. An increased number of cuts or a scalloped or fluted cross section could also be used to obtain a desired flow rate and pattern and can produce a variable thickness annular sheet of injected propellant as well as multiple streams. Further variations might include the turning down of the main surface within the shaped area, in effect combining the shapes of bolts 5 and 50.

OPERATING

Firing

The gun structure as illustrated in FIG. 1 is fully charged ready for firing with reservoir 35 filled with the liquid propellant to the capacity selected and with annular ring 62 of the annular piston 6 seated on surface 52 and seal 55 of the bolt so as to preclude leaking of the liquid propellant into the combustion chamber 36. Space 33 is charged with an inert liquid to provide a hydraulic support for annular piston wall 63 during firing. The liquid in 33 as already noted may be very viscous, may have lubricant properties, and may contain materials generally added to powders in conventional ammunitions for the treatment or preservation of barrels. The valves in conduits 45 and 47 are closed against leakage of the liquid propellant. Any existing pressure in space 10 and conduit 28 is relieved. Firing is initiated by means of activation of ignitor 26 which is provided with a charge or other means sufficient to create enough pressure in the combustion chamber 36 to unseat piston head 60 from its mating position with the end of bolt 5 by driving fill piston 7 rearwardly, partially collapsing belleville washers 14. In the alternative, a "blow-out" seal can be used at 55 so that the ignitor charge would pressurize the propellant in reservoir 35 to the extent required to rupture the seal 55. The igniter apparatus in either case will both cause an initial injection of liquid propellant from reservoir 35 into combustion chamber 36 and ignite the injected liquid propellant. Ignition of the liquid propellant flowing from reservoir 35 will increase the pressure in the combustion chamber and produce a regenerative feeding of liquid propellant from reservoir 35 into the combustion chamber because of the differential area piston head 60. As the pressure in combustion chamber 36 increases, it reaches the point of causing the obturation band portion 13 of the projectile 12 to become deformed and permit the projectile to move.

The shaped surface of the portion of the bolt indicated as 53 as illustrated in FIG. 1 would cause the space between the annular ring surface 62 of the piston head and bolt surface 53 to increase during early movement of the piston 6 to produce an ever increasing thickness of the annular sheet of liquid propellant injected into the enlarging combustion chamber. This increasing flow rate of liquid propellant would produce an increased burn rate with an attendant pressure increase which is adequate to overcome the increased volume of the combustion chamber caused both by displacement of the annular piston and by the accompanying displacement of the projectile 12. As the piston head 60 travels over the area of the bolt having the minimum radius at 53, the fuel sheet thickness would remain the same and flow rate would vary only in response to any acceleration of the piston 6. As piston head 6 approaches the forward portion 74 of the fill piston 7, the annular injection space between the annular ring surface defining the hole in the piston head and the bolt would decrease and cause the remaining liquid propellant in the reduced volume of reservoir 35 to cushion the impact of piston head 60 onto the fill piston 7 as the final quantity of the liquid propellant is injected and burned to sustain the firing pressure. The recoil momentum of annular piston 6 is transferred to fill piston 7 and to the breech structure 4 as ignition and firing pressures have used up the buffer action of assembly 44, but the buffer assembly, if desired, could be enhanced to permit part of the momentum to be dissipated by transfer of the forces into a buffer assembly 44 by means of the pins 16 and ring 15 and to the belleville washers or other structure used. Such arrangement would probably require more washers, longer pins and greater initial clearance between piston 7 and structure 4 or duplication of other structures if used.

One of the prime characteristics of this invention as noted above is the shaped portion of the bolt 5 at 53, or the comparable portion of bolt 50, over which piston 6 travels during firing which is shaped as calculated in terms of all of the parameters and dimensions to provide a predetermined flow rate of liquid propellant from the reservoir 35 through the opening or openings created between the cylindrical surface 62 of the piston and the bolt surface to generate the desired pressure/time curve for the particular mission. Another characteristic of this design is the use of the hydraulic support in the annulus 33 to support the piston skirt 63 to prevent deformation of that structure during firing. The fluid used as a hydraulic support for the piston wall 63 may be selected as already noted on the basis of its being inert to the combustion process in the combustion chamber, providing lubrication between piston ring area 61 and wall 30 of the chamber, having a specific heat content so that evaporation will assist cooling of the chamber wall, or having other specific properties.

Charging

At the completion of the firing, annular piston 6 is seated onto fill piston 7 with piston 7 being located against or near the stops 16 depending on the relationship of the reaction of the buffer assembly and dissipation of the chamber pressures. After the insertion of a new projectile 12 by whatever breech action means has been incorporated into the specific gun using this invention, hydraulic or pneumatic pressure may be inserted through conduit 28 to expand annular space 10 to drive both pistons, in register, toward the gun barrel until piston 6 seats onto the bolt nose portion surface 52. As piston 7 moves toward the barrel, connecting fill tube 78 slides within conduit 45 on the block so that there is a constant bridging between conduits 45 and 75. The pressure on conduit 28 is then relieved and the valve in conduit 45 is opened to admit the liquid propellant under pressure into the collapsed reservoir at 35.

As liquid propellant is inserted into and expands reservoir 35, fill piston 7 passes through the position illustrated in FIGS. 2 and 3 wherein a small volume of reservoir 35 is located between the interior surface 71 of piston 7 and a part of the reduced radius portion of the bolt at 53 or within troughs 56. So as to prevent, or at least reduce the amount of ullage in the liquid propellant in the reservoir, the valve in conduit 47 is left open sufficiently so that initially the propellant being inserted will drive air from the troughs 56 or from around the reduced portion 53 of the bolt, depending on the model of bolt present. When the reservoir is purged of air, the valve in 47 is closed so that the propellant inserted expands the reservoir by displacing piston 7. If necessary to prevent a reservoir expansion rate that would permit retention of air, space 10 can be pressurized, or merely cut off by the valve in 28, until the reservoir is purged. The same circulation of liquid propellant introduced through conduit 45 and bled out through conduit 47 can be used to circulate the liquid propellant if required to remove ullage. The fill process is continued until the fill piston seats onto stop 16 or until a lesser desired amount of liquid propellant is inserted as measured by some other means. The gun mechanism is then charged for a subsequent firing and the annular space 33 can be filled.

As an alternative fill procedure, piston 6 could be seated onto bolt surface 52 by some other means as, for example, a pushrod leaving reservoir 35 expanded but unfilled. Filling would then be accomplished by circulating propellant until propellant had completely filled reservoir 35 replacing all the air present.

SUMMARY

The foregoing describes the structure and operation of a regenerative monopropellant liquid propellant gun structure according to this invention employing the cooperation of a fixed axial bolt and an annular piston wherein the annular piston rod cooperates with other members to define a reservoir for liquid propellant, wherein the annular piston head overruns part of bolt as it moves in response to combustion pressure and cooperates with a shaped portion of the bolt to deliver a predetermined pattern and flow rate of propellant to the combustion chamber. An additional moveable piston member cooperates with the annular piston to define a variable capacity propellant reservoir to facilitate charging of the gun by permitting the capacity of the reservoir to be increased from zero to the desired content as the liquid propellant is introduced to preclude ullage. The injection pattern of propellant into the combustion chamber can be in different forms, e.g. a continuous annular sheet by use of structure as shown in FIG. 1 or in the form of distinct jets by use of structure as shown in FIG. 3, or in other patterns depending on the bolt configuration. Structural integrity is enhanced by use of hydraulic pressure support of the annular piston rod which also facilitates lubrication and cooling of the structure.

We claim:

1. In a direct injection regenerative liquid propellant gun structure having a breech casing containing a breech bore attachable at the forward end to a gun barrel and constituting a breech end at the other, the combination of:

a. a hollow differential area piston having an annular discoidal head moveably journaled in the bore to define with said casing a variable capacity combustion chamber in the forward end of said bore and having a cylindrical skirt extending from the outer portion of said head rearwardly to define an included propellant reservoir, the area of said head exposed to said combustion chamber being larger than the area of said head exposed to said reservoir; and b. an axial bolt fixed in said bore by supporting means and extending through said reservoir and through the hole in said annular discoidal head, said bolt being generally cylindrical with a base portion, a terminal nose portion journaled into the hole in said annular discoidal head when said head is in its forward most position to preclude flow of a liquid through said hole from said reservoir to said combustion chamber and an intermediate portion between said base and nose portions, said intermediate portion having a shaped surface causing one or more spaces to occur between said bolt and said annular discoidal head as said head moves rearwardly from its forward most position to permit a flow of liquid through said hole from said reservoir to said combustion chamber.

2. The gun structure of claim 1 wherein:

said shaped intermediate portion of said bolt is generally cylindrical with one or more cut away portions running longitudinally of said bolt;

whereby, during firing, propellant will be injected from said reservoir through said hole into said combustion chamber in one or more streams.

3. The gun structure of claim 2 wherein:

the number and spacing of the plurality of cut away portions are selected to limit acoustic resonance whereby acoustic resonance is limited.

4. The gun structure of claim 1 wherein:

said shaped intermediate portion of said bolt is a generally cylindrical portion having reduced radii;

whereby said one or more spaces between said bolt and said annular discoidal head is an annulus.

5. The gun structure of claim 4 wherein:

said shaped portion of said bolt having reduced radii has a plurality of radii which define a surface which will cause said annulus to be of a size at each piston position as required to produce a predetermined flow rate during piston movement;

whereby, when the gun is operated, propellant will be injected from said reservoir into said combustion chamber in an annular sheet which changes in thickness during piston travel.

6. The gun structure of claim 5 wherein:

said shaped portion is also scalloped;

whereby said annular sheet of propellant is varied in thickness around its extent.

7. The gun structure of claim 1 further comprising the combination of:

c. a second piston located in said breech bore between said annular hollow piston and said breech end, said second piston is a free piston having a forward portion configured for mating reception within said annular hollow piston to constitute a moveable rear wall to said propellant reservoir, a rear portion journaled in said breech bore and an axial bore through which said bolt extends;

d. sealing means cooperating with said nose portion of said bolt and said annular discoidal cylinder head to facilitate seating of said head on said nose portion and precluding flow of liquid propellant as long as said head is seated;

e. force transfer means for moving said second piston forward to mating position within said hollow piston and for moving said hollow piston forward to seat on said nose portion; and f. conduit means for introducing a liquid propellant between said pistons to create and fill said propellant reservoir by forcing said second piston rearwardly in response to introduction of said propellant;

whereby said reservoir can be filled by reservoir expansion rather than by displacement of another substance.

8. The gun structure improvement of claim 7 wherein:

said sealing means cooperating to facilitate seating of said head on said nose portion is caused to leak by pressure in the combustion chamber created by the firing of an ignition charge in said combustion chamber.

9. The gun structure improvement of claim 7 wherein:

said shaped intermediate portion of said bolt is generally cylindrical with one or more longitudinal cut away portions, whereby during firing, propellant will be injected from said reservoir through said hole into said combustion chamber in one or more streams.

10. The gun structure improvement of claim 9 wherein:

the number and spacing of said plurality of longitudinal cut away portions are selected to limit acoustic resonance.

11. The gun structure of claim 7 wherein:

said shaped intermediate portion of said bolt is a generally cylindrical portion having reduced radii;

whereby said one or more spaces between said bolt and said annular discoidal head is an annulus,

12. The gun structure improvement of claim 11 wherein:

said shaped portion of said bolt having reduced radii has a plurality of radii which define a surface which will cause said annulus to be of a size at each position of said differential area piston to produce a predetermined flow rate and pattern of propellant.

whereby, when the gun is operated, propellant will be injected from said reservoir through said hole into said combustion chamber in an annular sheet of a thickness determined to produce the desired ballistics.

13. The gun structure improvement of claim 12 wherein:

said shaped portion is also scalloped;

whereby said annular sheet of propellant is of nonuniform thickness around it.

14. An annular piston breech assembly for a direct injection regenerative liquid propellant gun having a breech casing containing a breech bore having a forward end for joining to a gun barrel and a breech end comprising:

a. an annular hollow differential area piston having an annular discoidal head moveably journaled in the breech bore, defining with said casing a variable capacity combustion chamber in the forward end of said bore and having a cylindrical skirt extending from the outer portion of said head rearwardly defining an including propellant reservoir, the area of said head exposed to said combustion chamber being larger than the area of said head exposed to said reservoir, b. a second piston located in said breech bore between said annular hollow piston and said breech end, said second piston having a forward portion configured for mating reception within said annular hollow piston to constitute a moveable rear wall to said propellant reservoir and an axial bore;

c. an axial bolt fixed in said bore and extending through said second piston, said reservoir and said annular discoidal head, said bolt being generally cylindrical with a base portion, a terminal nose portion journaled into the hole in said annular discoidal head when said head is in its forward most position to preclude flow of a liquid from said reservoir to said combustion chamber and an intermediate portion running rearwardly from said nose portion, said intermediate portion having a shaped surface causing one or more spaces to occur between said bolt and said annular discoidal head to permit a flow of liquid through said hole from said reservoir to said combustion chamber as said head is driven rearwardly from its forward most position by combustion pressures overrunning said intermediate portion of said bolt;

e. force means for moving said second piston forward to mating position within said hollow piston and thereafter moving both said pistons forward to seat said hollow piston on said nose portion of said bolt;

f. valved supply conduit means for introducing a liquid propellant between said pistons to create and fill said propellant reservoir by forcing said second piston rearwardly in response to introduction of said propellant and for maintaining said propellant in said reservoir against back pressure created by firing;

g. sealing means cooperating with said nose portion of said bolt and said annular discoidal cylinder head to facilitate seating of said head on said nose portion and precluding flow of liquid propellant as long as said head remains seated, said sealing means being disruptable by a predetermined pressure in said combustion chamber to permit flow of liquid propellant from said reservoir to said combustion chamber; and h. igniter means in said combustion chamber for creating an initial pressurization of the combustion chamber and igniting liquid propellant forced from the reservoir into said combustion chamber;

whereby activation of the igniter means causes a combustion chamber pressure which ignites a flow of propellant from reservoir to combustion chamber.

whereby the propellant in the reservoir will be forced from the reservoir by the differential area piston with a flow rate and pattern as predetermined by the configuration of said intermediate portion of said bolt.

15. The annular piston breech assembly of claim 14 wherein:

said cylindrical skirt of said annular hollow differential area piston extending from outer portion of said discoidal head within said breech bore is spaced from the breech casing wall bounding the breech bore to define a cylindro-annular space between said skirt and said casing wall defined at one end by the rim of said discoidal head, said assembly also includes a mechanical barrier means on said breech casing wall extending into said breech bore bearing on said skirt closing the end of said cylindro-annular space remote from said discoidal head, and valved conduit means communicating with said cylindro-annular space for charging said space with a fluid substance, whereby said skirt is supported against deformation during firing by equalizing the pressure on both sides of said skirt, and whereby said substance is pumped past said rim into said combustion chamber.

16. The annular piston breech assembly of claim 14 wherein:

said bolt includes valved relief conduit means for removing fluid from said reservoir through said breech during the process of filling the reservoir with liquid propellant.

17. The annular piston breech assembly of claim 14 wherein:

said shaped intermediate portion of said bolt is generally cylindrical with one or more longitudinal cut away portions, whereby, when operated, propellant will be injected from said reservoir into said combustion chamber in a stream from each said cut away portion.

18. The annular piston breech assembly of claim 14 wherein:

said sealing means cooperating to facilitate seating of said head on said nose portion has a predetermined resistance to pressure which is caused to leak by pressure in the combustion chamber created by the firing of an ignition charge in said combustion chamber.

19. The annular piston breech assembly of claim 14 wherein:

said shaped intermediate portion of said bolt is a portion having reduced radii, whereby said one or more spaces between said bolt and said annular discoidal head is an annulus.

20. The annular piston breech assembly of claim 19 wherein:

said shaped portion of said bolt having reduced radii is a contoured portion having a plurality of radii, whereby said annulus changes in size as said differential area piston is driven by combustion pressure, whereby, when the gun is operated, propellant will be injected from said reservoir into said combustion chamber in an annular sheet which changes in thickness during movement of said annular piston to vary the rate of injection to implement a predetermined plan.

21. In a direct injection regenerative liquid propellant gun structure having a breech casing defining a breech bore having a barrel end and a breech end, the improvement comprising the combination of:

a shaped member within said vore extending from a base portion near said breech end to a nose portion nearer said barrel end of said bore;

mechanical means for supporting said shaped member and fixing said member with respect to said casing;

a differential area piston dividing the space in said breech bore between a combustion chamber at said barrel end on one side of said piston and a propellant reservoir on the second side of said piston, said differential area piston having a cut out portion for overrunning said shaped member as said piston moves along said shaped member from a gun charged postion to a discharged position in response to pressure created in said combustion chamber to compress said reservoir to force propellant from said reservoir between said shaped member and the edge of said cut out portion of said piston, said shaped member being shaped along a substantial portion of its extent within said reservoir so as to define one or more spaces between said member and said edge of said cut out portion, the shape and dimension of said one or more spaces at any piston position being a function of the shape of said shaped member, whereby the quantity, flow rate and flow pattern of propellant injected into the combustion chamber can be programmed by establishing the shape of the shaped member; and said shaped member is elongated, is spaced from said casing so as to be surrounded by material in said reservoir, and extends sufficiently toward said barrel end of said casing so that said nose portion is within said cut out portion of said piston when said piston is in its gun charged position;

said mechanical means supports said shaped member by its base portion;

said nose portion of said shaped member conforming to said cut out portion of said piston so as to reduce said spaces between the two to zero;

whereby when said piston is in a gun charged position, the interface between said shaped member and said piston precludes flow of propellant to said combustion chamber; and whereby said one or more spaces between said shaped member and said edge of said cut out portion meters propellant flowing from said reservoir to said combustion chamber as said piston is driven from its gun charged position to its discharged position; and said shaped member is generally cylindrical and has a reduced turned portion of one or more radii extending from said nose portion toward said base portion;

said cut out portion of said piston is defined by a generally cylindrical surface of said piston fitting the unreduced nose portion of said shaped member;

whereby said one or more spaces comprise an annular space defined by said reduced portion and said surface defining said cut out portion;

whereby the flow of propellant from reservoir to combustion chamber is in the form of an annular sheet of thickness determined by the relationship of said radii to the size of the unturned portion of said shaped member.

22. The gun structure improvement of claim 21 wherein:

said differential area piston is an annular piston having a discoidal head containing said cut out portion and a cylindrical skirt portion extending from proximate the rim of said head toward said breech end of said bore, said annular piston defining said propellant reservoir as an open ended cylinder.

23. The gun structure improvement of claim 22 further comprising:

d. a second piston journaled on said shaped member having a forward portion journaled into said annular piston defining the remaining end of the cylindrical reservoir, the forward portion of said second piston having a shape mating to the inside of said differential area piston so that the reservoir can be substantially emptied;

e. conduit means for filling said reservoir with a liquid monopropellant; and f. igniter means in said combustion chamber.

24. The gun structure improvement of claim 21 wherein:

said annular space is determined by a reduced turned portion having a plurality of radii which cause said reduced portion to have a contoured surface;

whereby the thickness of said annular sheet changes according to the contoured surface during travel of said piston from its gun charged position to gun discharged position during firing.

25. The gun structure improvement of claim 24 wherein:

said differential area piston is an annular piston having a discoidal head containing said cut out portion and a cylindrical skirt portion extending from proximate the rim of said head toward said breech end of said bore, said annular piston defining said propellant reservoir as an open ended cylinder.

26. The gun structure of claim 25 further comprising:

d. a second piston journaled on said shaped member having a base portion journaled into said breech bore and a forward portion journaled into said annular piston defining the remaining end of the cylindrical reservoir, the forward portion of said second piston having a shape mating to the inside of said differential area piston so that the reservoir can be substantially emptied;

e. cooperating mechanical means mounted on the exterior of said skirt and on the inside of said casing wall for holding and for dispensing into said combustion chamber, responsive to movement of said differential area piston during firing, materials facilitating lubrication, heat transfer, and cleaning;

f. conduit means for filling said reservoir with a liquid monopropellant; and g. igniter means in said combustion chamber.

27. In a direct injection regenerative liquid propellant gun structure having a breech casing defining a breech bore having a barrel end an a breech end, the improvement comprising the combination of:

a shaped member within said bore extending from a base portion near said breech end to a nose portion nearer said barrel end of said bore;

mechanical means for supporting said shaped member and fixing said member with respect to said casing;

a differential area piston dividing the space in said breech bore between a combustion chamber at said barrel end on one side of said piston and a propellant reservoir on the second side of said piston, said differential area piston having a cut out portion for overrunning said shaped member as said piston moves along said shaped member from a gun charged position to a discharged position in response to pressure created in said combustion chamber to compress said reservoir to force propellant from said reservoir between said shaped member and the edge of said cut out portion of said piston, said shaped member being shaped along a substantial portion of its extent within said reservoir so as to define one or more spaces between said member and said edge of said cut out portion, the shape and dimension of said one or more spaces at any piston position being a function of the shape of said shaped member, whereby the quantity, flow rate and flow pattern of propellant injected into the combustion chamber can be programmed by establishing the shape of the shaped member; and said shaped member is elongated, is spaced from said casing so as to be surrounded by material in said reservoir, and extends sufficiently toward said barrel end of said casing so that said nose portion is within said cut out portion of said piston when said piston is in its gun charged position;

said mechanical means supports said shaped member by its base portion;

said nose portion of said shaped member conforming to said cut out portion of said piston so as to reduce said spaces between the two to zero;

whereby when said piston is in a gun charged position, the interface between said shaped member and said piston precludes flow of propellant to said combustion chamber; and whereby said one or more spaces between said shaped member and said edge of said cut out portion meters propellant flowing from said reservoir to said combustion chamber as said piston is driven from its gun charged position to its discharged position; and said shaped member is generally cylindrical and has one or more recesses in its surface between said nose portion and its base portion;

said cut out portion of said piston is defined by a generally cylindrical surface of said piston fitting the surface of the generally cylindrical shaped member;

whereby said one or more spaces are defined by said one or more recesses;

whereby the flow of propellant from reservoir into said combustion chamber is in the form of one or more streams corresponding in number and size to said recesses; and said one or more recesses comprise a plurality of elongated recesses spaced around the surface of said shaped member;

whereby said flow of propellant is in the form of a plurality of discrete streams spaced around said nose of said shaped member within said combustion chamber; and said elongated recesses each vary in one or more of its dimensions over its length;

whereby said plurality of streams each vary in flow rate as said piston travels; and said differential area piston is an annular piston having a discoidal head containing said cut out portion and a cylindrical skirt portion extending from proximate the rim of said head toward said breech end of said bore, said annular piston defining said propellant reservoir as an open ended cylinder.

28. The gun structure of claim 27 further comprising:

d. a second piston journaled on said shaped member having a base portion journaled into said breech bore and a forward portion journaled into said annular piston defining the remaining end of the cylindrical reservoir, the forward portion of said second piston having a shape mating to the inside of said differential area piston so that the reservoir can be completely emptied;

e. conduit means for filling said reservoir with a liquid monopropellant; and f. igniter means in said combustion chamber.

29. The gun structure of claim 28 further comprising:

g. cooperating mechanical means on the exterior of said skirt and on the inside of said casing wall defining a dispenser for holding and for dispensing into said combustion chamber responsive to movement of said differential area piston during firing, materials facilitating lubrication, heat transfer, and cleaning; and h. hydraulic conduit means communicating with said dispenser for charging said space with a fluid substance to support and reinforce said skirt against deformation during firing by transfer of forces on said reservoir to said casing and for dispensing said materials into said combustion chamber.

30. In a direct injection regenerative liquid propellant gun structure having a breech casing defining a breech bore having a barrel end and a breech end, the improvement comprising the combination of:

a shaped member within said bore extending from a base portion near said breech end to a nose portion nearer said barrel end of said bore;

mechanical means for supporting said shaped member and fixing said member with respect to said casing;

a differential area piston dividing the space in said breech bore between a combustion chamber at said barrel end on one side of said piston and a propellant reservoir on the second side of said piston, said differential area piston having a cut out portion for overrunning said shaped member as said piston moves along said shaped member from a gun charge position to a discharged position in response to pressure created in said combustion chamber to compress said reservoir to force propellant from said reservoir between said shaped member and the edge of said cut out portion of said piston;

said shaped member being shaped along a substantial portion of its extent within said reservoir so as to define one or more spaces between said member and said edge of said cut out portion, the shape and dimension of said one or more spaces at any piston position being a function of the shape of said shaped member;

whereby the quantity, flow rate and flow pattern of propellant injected into the combustion chamber can be programmed by establishing the shape of the shaped member;

said shaped member is elongated, is spaced from said casing so as to be surrounded by material in said reservoir, and extends sufficiently toward said barrel end of said casing so that said nose portion is within said cut out portion of said piston when said piston is in its gun charged position;

said mechanical means supports said shaped member by its base portion;

said nose portion of said shaped member conforming to said cut put portion of said piston so as to reduce said spaces between the two to zero;

whereby when said piston is in a gun charged position, the interface between said shaped member and said piston precludes flow of propellant to said combustion chamber; and whereby said one or more spaces between said shaped member and said edge of said cut out portion meters propellant flowing from said reservoir to said combustion chamber as said piston is driven from its gun charged position to its discharged position;

said shaped member is generally cylindrical and has one or more recesses in its surface between said nose portion and its base portion;

said cut out portion of said piston is defined by a generally cylindrical surface of said piston fitting the surface of the generally cylindrical shaped member;

whereby said one or more spaces are defined by said one or more recesses;

whereby the flow of propellant from reservoir into said combustion chamber is in the form of one or more streams corresponding in number and size to said recesses; and said one or more recesses comprise a plurality of elongated recesses spaced around the surface of said shaped member;

whereby said flow of propellant is in the form of a plurality of discrete streams spaced around said nose of said shaped member within said combustion chamber; and said elongated recesses each vary in one or more of its dimensions over its length;

whereby said plurality of streams each vary in flow rate as said piston travels; and there are a sufficient number of said elongated recesses to cause said streams to join as the propellant disperses to approximate an annular sheet of propellant of nonuniform thickness.

31. In a direct injection regenerative liquid propellant gun structure in which a differential area annular piston journaled in a breech bore in a casing is forced away from the barrel end of the breech bore by pressure in a combustion chamber during firing to exert pressure on a propellant reservoir also in said bore, the improvement comprising:

material holding and dispensing means interposed between said piston and said casing for injecting a material into the combustion chamber responsive to movement of the piston during firing; and said material holding and dispensing means comprising:

a first mechanical means on the interior surface of said casing;

a second mechanical means on the exterior of said piston;

a space between said piston and said bore between said mechanical means defining a variable capacity container; and conduit means for introducing a fluid to said container, said mechanical means being separated longitudinally of said bore so that, during travel of said piston during firing, said container is substantially reduced.

32. In a direct injection regenerative liquid propellant gun structure having a breech casing defining a breech bore having a barrel end and a breech end, the improvement comprising the combination of:

a breech end bore obturator, which is releasably fixed to said casing;

a shaped member within said bore extending from a base portion near said breech end to a nose portion nearer said barrel end of said bore;

mechanical means supporting said shaped member and not-releasably fixing said member to said obturator;

a differential area piston dividing the space in said breech bore between a combustion chamber at said barrel end on one side of said piston and a propellant reservoir on the second side of said piston, said differential area piston having a cut out portion for overrunning said shaped member as said piston moves along said shaped member from a gun charged position to a discharged position in response to pressure created in said combustion chamber to compress said reservoir to force propellant from said reservoir between said shaped member and edge of said cut out portion of said piston, said shaped member being shaped along a substantial portion of its extent within said reservoir so as to define one or more spaces between said member and said edge of said cut out portion, the shape and dimension of said one or more spaces at any piston position being a function of the shape of said shaped member, whereby the quantity, flow rate nd flow pattern of propellant injected into the combustion chamber can be programmed by establishing the shape of the shaped member.

33. The improvement of claim 31 wherein:

said first mechanical means is a more effective barrier to passage of a fluid substance in said container than is said second mechanical means, whereby said container may be used as a dispenser to force a material past said second mechanical means to said combustion chamber during firing.

34. The improvement of claim 31 wherein:

said first mechanical means includes a ring set into a groove in said casing;

said second mechanical means is the rim of the head of said piston;

said space is defined in part by a portion of said piston having a smaller diameter than the rim of said piston head.

35. In a direct injection regenerative liquid propellant gun structure having a breech casing defining a breech bore having a barrel end and a breech end, the improvement comprising the combination of:

a breech end bore obturator which is releasably fixed to said casing;

a shaped member within said bore extending from a base portion near said breech end to a nose portion nearer said barrel end of said bore;

a mechanical means supporting said shaped member and not-releasably fixing said member to said obturator;

a differential area piston dividing the space in said breech bore between a combustion chamber at said barrel end on one side of said piston and a propellant reservoir on the second side of said piston, said differential area piston having a cut out portion for overrunning said shaped member as said piston moves along said shaped member from a gun charged position to a discharged position in response to pressure created in said combustion chamber to compress said reservoir to force propellant from said reservoir between said shaped member and the edge of said cut out portion of said piston, said shaped member being shaped along a substantial portion of its extent within said reservoir so as to define one or more spaces between said member and said edge of said cut out portion, the shape and dimension of said one or more spaces at any piston position being a function of the shape of said shaped member, whereby the quantity, flow rate and flow pattern of propellant injected into the combustion chamber can be programmed by establishing the shape of the shaped member.

said shaped member is elongated, is spaced from said casing so as to be surrounded by material in said reservoir, and extends sufficiently toward said barrel end of said casing so that said nose portion is within said cut out portion of said piston when said piston is in its gun charged position;

said mechanical means supports said shaped member by its base portion;

said nose portion of said shaped member conforming to said cut out portion of said piston so as to reduce said spaces between the two to zero;

whereby when said piston is in a gun charged position, the interface between said shaped member and said piston precludes flow of propellant to said combustion chamber; and whereby said one or more spaces between said shaped member and said edge of said cut out portion meters propellant flowing from said reservoir to said combustion chamber as said piston is driven from its gun charged position to its discharged position.

* * * * *